US005928012A

United States Patent [19]

Kitamura

[11] Patent Number: 5,928,012

[45] Date of Patent: Jul. 27, 1999

[54] LEVER-TYPE CONNECTOR

[75] Inventor: Hiroshi Kitamura, Kawasaki, Japan

[73] Assignee: The Whitaker Corporation, Wilmington, Del.

[21] Appl. No.: 08/959,866

[22] Filed: Oct. 29, 1997

[30] Foreign Application Priority Data

Oct. 31, 1996 [JP] Japan ..... 8-305840

[51] Int. Cl.[6] ..... H01R 13/62

[52] U.S. Cl. ..... 439/157

[58] Field of Search ..... 439/152, 157, 439/159, 160, 347, 372, 259, 266

[56] References Cited

U.S. PATENT DOCUMENTS

| | | | |
|---|---|---|---|
| 5,391,086 | 2/1995 | Woller et al. | 439/157 |
| 5,463,912 | 11/1995 | Inoue et al. | 74/519 |
| 5,489,224 | 2/1996 | Schwarz | 439/752 |
| 5,489,244 | 2/1996 | Schwarz | 439/752 |
| 5,681,175 | 10/1997 | Busse et al. | 439/157 |

FOREIGN PATENT DOCUMENTS 0 722 203 A1 7/1996 European Pat. Off. ..... H01R 13/629

OTHER PUBLICATIONS

Search Report Under Section 17, Application No. GB 9722856.3, Date of Search, Feb. 13, 1998.

*Primary Examiner*—Gary F. Paumen
*Assistant Examiner*—Truc T. Nguyen

[57] ABSTRACT

The present invention provides a compact lever-type connector with a large degree of freedom in design, which makes it possible to obtain a low-mating force. A lever 10 which has gears 26, and slides 30 which have racks 40 and cam grooves 36*a* through 36*c* and 37*a* through 37*c* that engage with cam followers of the mating connectors, are attached to a cap housing 2. The racks 40 are driven by the gears 26 of the lever 10. These racks 40 and the cam grooves 36*a* through 36*c* and 37*a* through 37*c* are respectively formed on opposite sides of the slides 30.

5 Claims, 7 Drawing Sheets

LEVER-TYPE CONNECTOR

FIELD OF THE INVENTION

The present invention relates to a lever-type connector, and more specifically relates to a lever-type connector which combines slides and a lever.

BACKGROUND OF THE INVENTION

Conventionally, lever-type connectors and slide-type connectors have been used as a means of reducing the mating force between connectors. Furthermore, connectors in which a low-mating force is obtained by combining a lever and slides are also known. For example, the electrical connector disclosed in Japanese Patent Publication No. 7-192801 is shown in FIG. 7.

This electrical connector 200 has a housing assembly 202 and a housing 204 which mate with each other. A lever 208, which has gears 206, is pivot mounted on pivot pins 210 on the housing assembly 202 so that lever 208 is free to pivot relative thereto. Furthermore, cam grooves 214 on slides 212 are formed in the direction of the length of the housing assembly 202 so that sliding of the slides 212 along housing assembly 212 takes place. Bosses 218 on the housing 204 engage with the cam grooves 214 of the slides 212, and the gears 206 of the lever 208 engage with racks 216 on the slides 212. As a result, the housing assembly 202 and housing 204 can be mated with each other or disconnected from each other when the lever 208 is pivotably moved.

However, in the construction described above, the racks 216 are positioned between two cam grooves 214 in the direction of the length of the slides 212. As a result, the dimensions of the racks 216 are restricted, i. e., the length of the racks 216 is restricted, so that there is a danger that the desired low-operating force of the lever 208 cannot be obtained. Furthermore, if the length of the racks 216 is increased, the size of the slides 212 is increased, so that the overall dimensions of the connector 200 are also increased. If the external dimensions of the connector 200 are limited, there are restrictions on how gradual the inclination of the cam grooves 214 can be, so that there are also limits on how far the mating force can be reduced. Furthermore, since the racks 216 are located between two cams 214, the position of the lever is necessarily determined, so that the degree of freedom in the design of the connector is limited.

SUMMARY OF THE PRESENT INVENTION

A lever-type connector comprises a housing having guide grooves; slides slidably mounted in the guide grooves, each of the slides having a rack and cam grooves with the rack and cam grooves of each of the slides being disposed on opposite sides thereof; and a lever pivotally mounted on the housing and having gears engagable with the rack of each of the slides to slide the slides along the guide grooves when the lever is operated.

One feature of the present invention is to provide a lever-type connector which has a low-mating force without increasing the size of the connector.

Another feature of the present invention is to provide a lever-type connector which has a large degree of freedom in design.

The lever-type connector of the present invention is equipped with slides which each have a rack and cam grooves, and a lever which has gears that engage with the racks, and which causes the slides to slide by means of the gears, the racks and the cam grooves are respectively disposed on opposite sides of the slides.

BRIEF DESCRIPTION OF THE DRAWINGS

Embodiments of the invention will now be described by way of example with reference to the accompanying drawings in which.

DETAILED DESCRIPTION OF THE INVENTION

Figure 1:
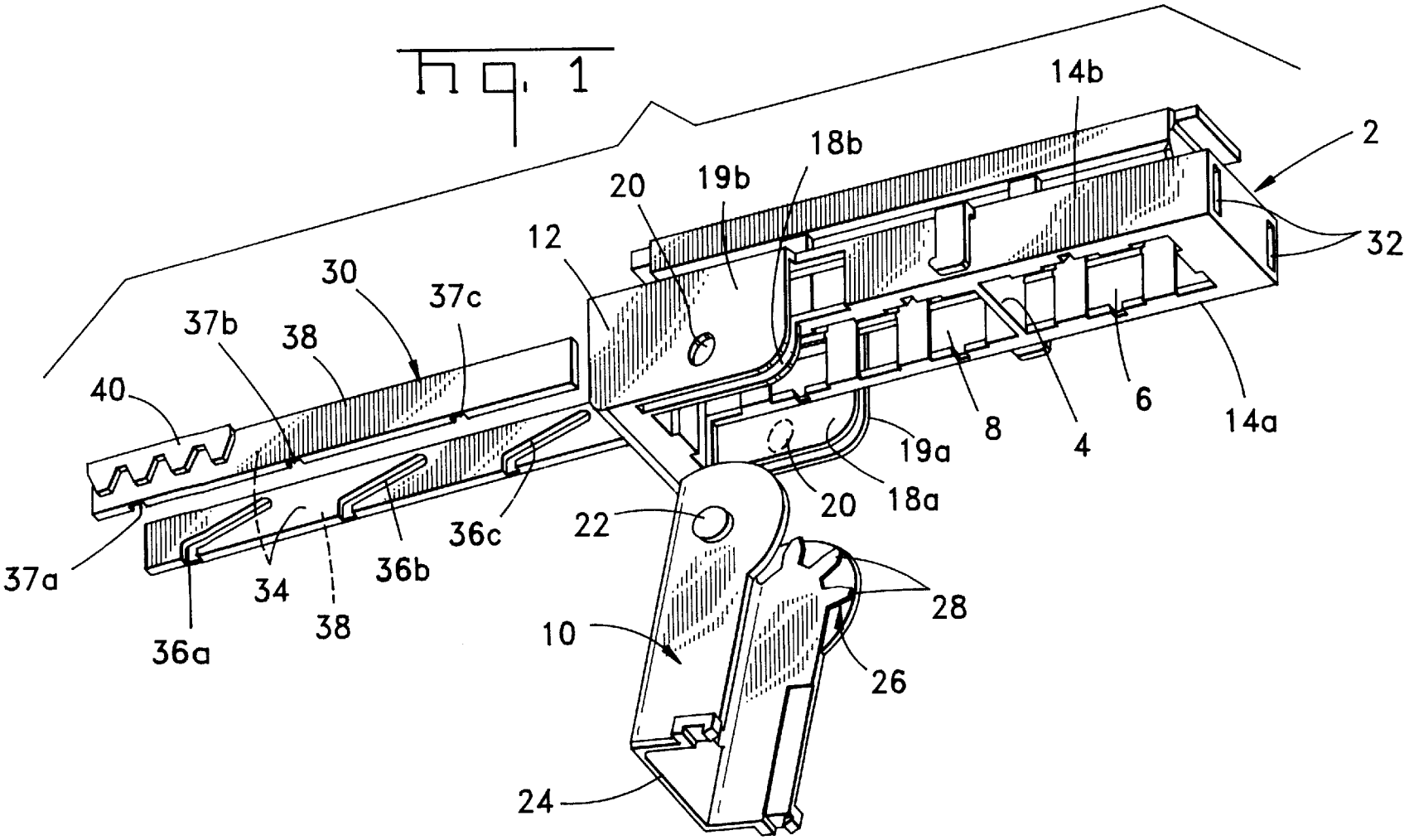
FIG. 1 is an exploded perspective view of a lever-type connector of the present invention.

FIG. 1 is an exploded perspective view which illustrates an embodiment of the lever-type connector 1 of the present invention. Here, a substantially rectangular cap housing 2 made of a suitable plastic has cavities 6 and 8, separated by a rib 4 which are used for the insertion of plug housings 70 and 72 (see FIG. 2), and a lever-mounting section 12 which is used for the mounting of a lever 10 thereto. The lever attachment part 12 has double walls, i. e., inner walls 18*a* and 18*b* and outer walls 19*a* and 19*b*, which extend along side walls 14*a* and 14*b* of the cap housing 2. Round holes 20 are formed in the outer walls 19*a* and 19*b*, and round projections 22, which are on lever 10 and act as pivoting shafts for the lever 10, are inserted between the double walls and disposed within the round holes 20. The electrical terminals are omitted from the drawings for purposes of simplicity. The cap housing 2 has guide grooves 32 which accommodate slides 30 so that the slides 30 are free to slide therealong.

The lever 10 consists of a single plastic member which is C-shaped in cross section at its outer end. Lever 10 has an operating part 24, which is operated by hand, and gears 26. The gears 26 have teeth 28 which are formed around a portion of the circumference of each gear 26.

The slides 30 are constructed of two flat plate-form members; cam grooves 36*a*, 36*b*, 36*c*, 37*a*, 37*b* and 37*c* are formed at substantially equal intervals in the inside surfaces 34 of slides 30. Racks 40 are formed on the outside surfaces 38 of the slides in positions corresponding to the locations of respective cam grooves 36*a* and 37*a*. In other words, the racks 40 are formed on the opposite surfaces of the slides 30 so that the racks 40 overlap with the cam grooves 36*a* and 37*a* in a back to back relationship.

Figure 2:
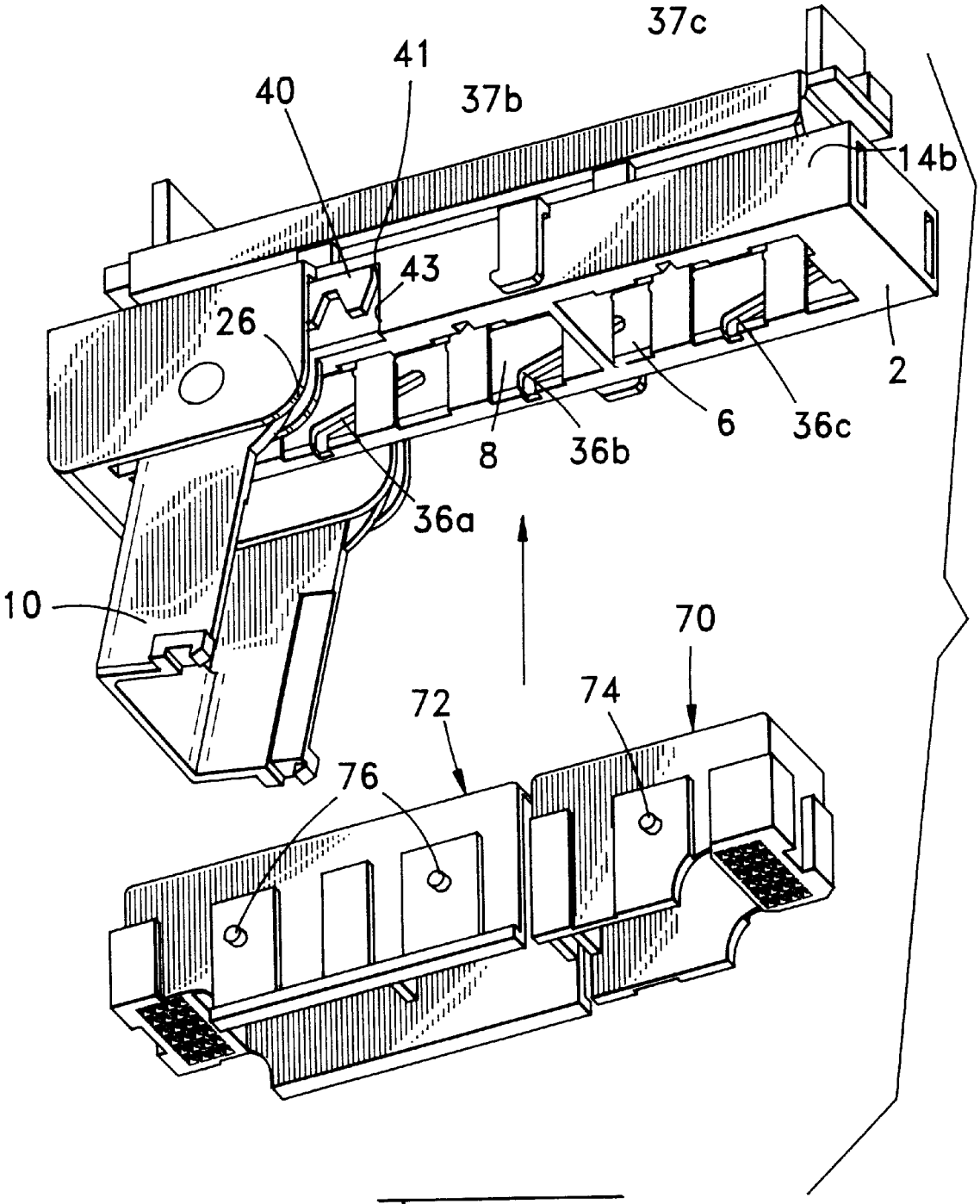
FIG. 2 is a perspective view of an assembled lever-type connector shown in FIG. 1, together with the plug housing explode therefrom.

FIG. 2 is a perspective view which illustrates the insertion of the mating plug housings 70 and 72 into the assembled lever-type connector 1. In FIG. 2, the racks 40 and the gears 26 are in an engaged state. When the cam grooves 36*a* through 36*c* and 37*a* through 37*c* are in prescribed positions, the initial position of the lever 10 may be regulated by causing the end portions 41 of the racks 40 to engage the edges of openings 43 formed in the side walls 14*a*, 14*b*. The plug housings 70 and 72 are independent of each other and are respectively inserted into the cavities 6 and 8 of cap housing 2. Cam followers in the form of bosses 74, are formed on both sides of the plug housing 70, and these bosses 74 are inserted into the cam grooves 36*c* and 37*c* of the slides 30. Furthermore, four bosses 76 are formed on the plug housing 72, and these bosses 76 are inserted into the cam grooves 36*a*, 36*b*, 37*a* and 37*b*.

Figure 3:
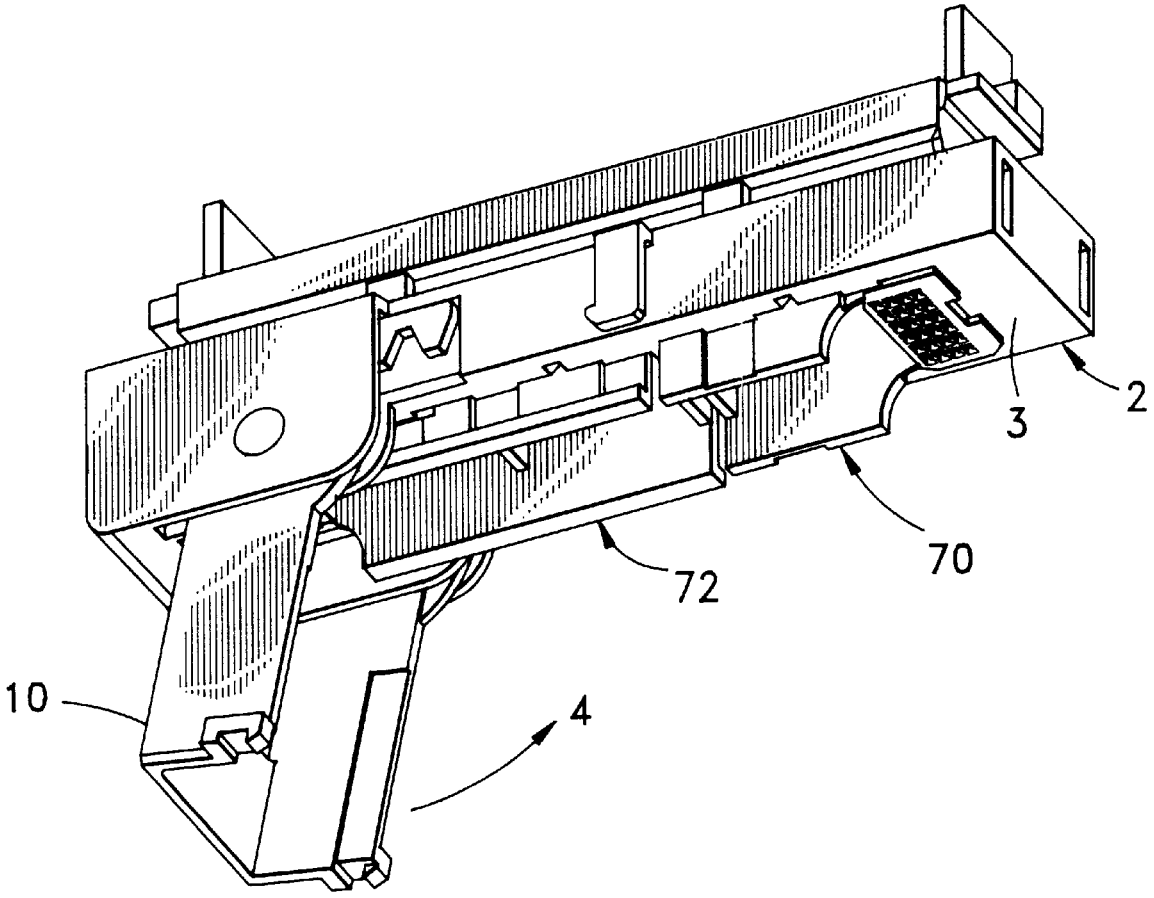
FIG. 3 is a perspective view showing the plug housing inserted into the lever-type connector.

FIG. 3 is a perspective view which shows the plug housings 70 and 72 partly inserted into the cap housing 2. In this state, the plug housings 70 and 72 protrude a considerable distance from the engagement surface of the cap housing 2.

Figure 4:
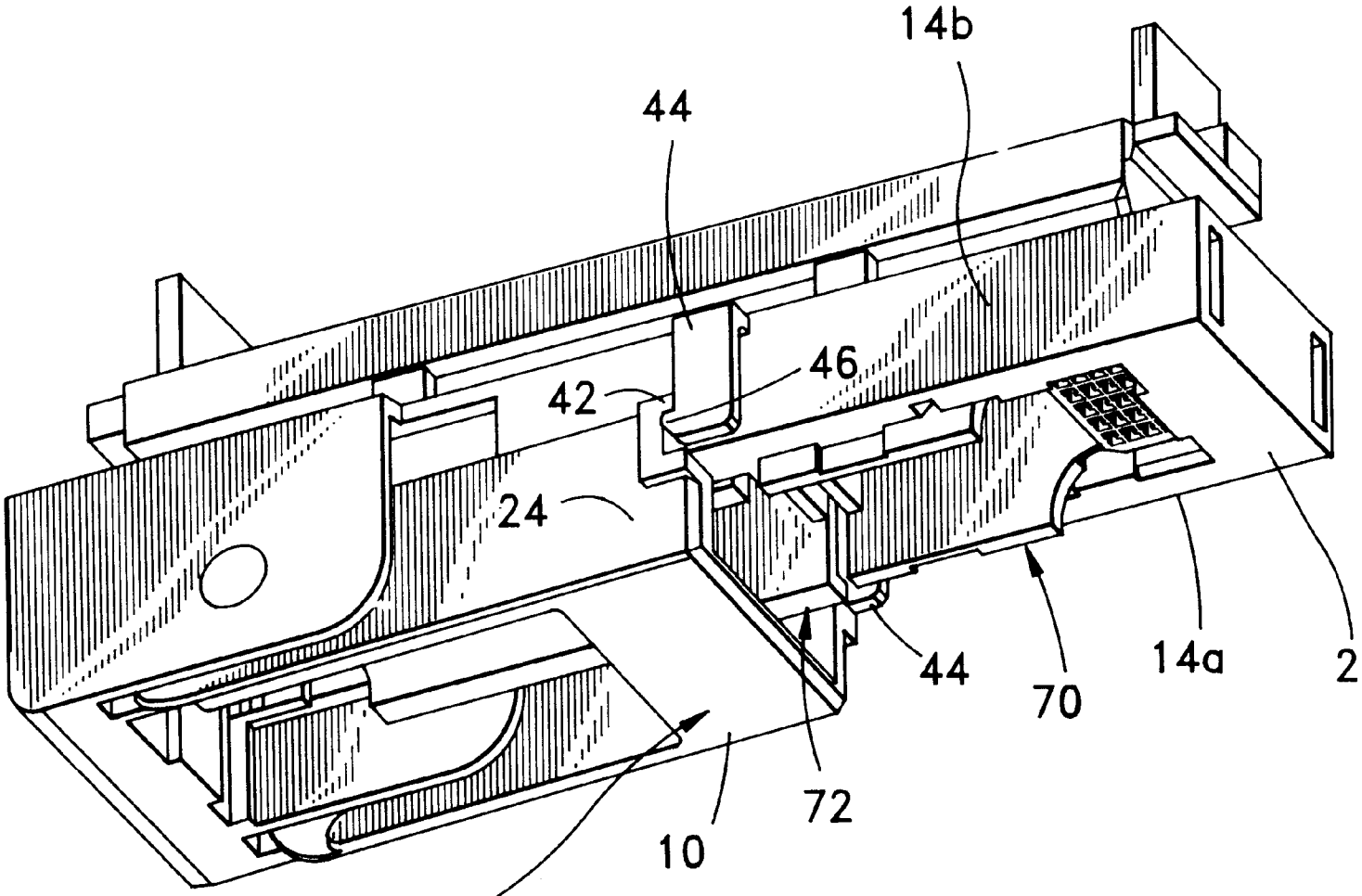
FIG. 4 is a perspective view showing the lever pivoted to a find position.

Next, FIG. 4 is a perspective view illustrating a state in which the lever 10 has been pivoted in the direction indicated by arrow A, so that the plug housings 70 and 72 are completely mated with the cap housing 2. The plug housings 70 and 72 are pulled inward by the cam grooves 36*a* through 36*c* and 37*a* through 37*c* as a result of the movement of the slides 30 in a universally known manner, so that the plug housings 70 and 72 are respectively mated with the cap housing 2. When the lever 10 is caused to pivot into its final position, slots 42 formed on the end portions of the operating part 24 engage with the projections 46 of latch arms 44 protruding from the side walls 14*a*, 14*b*, so that the lever 10 is latchably maintained at the final pivoting position.

Figure 5:
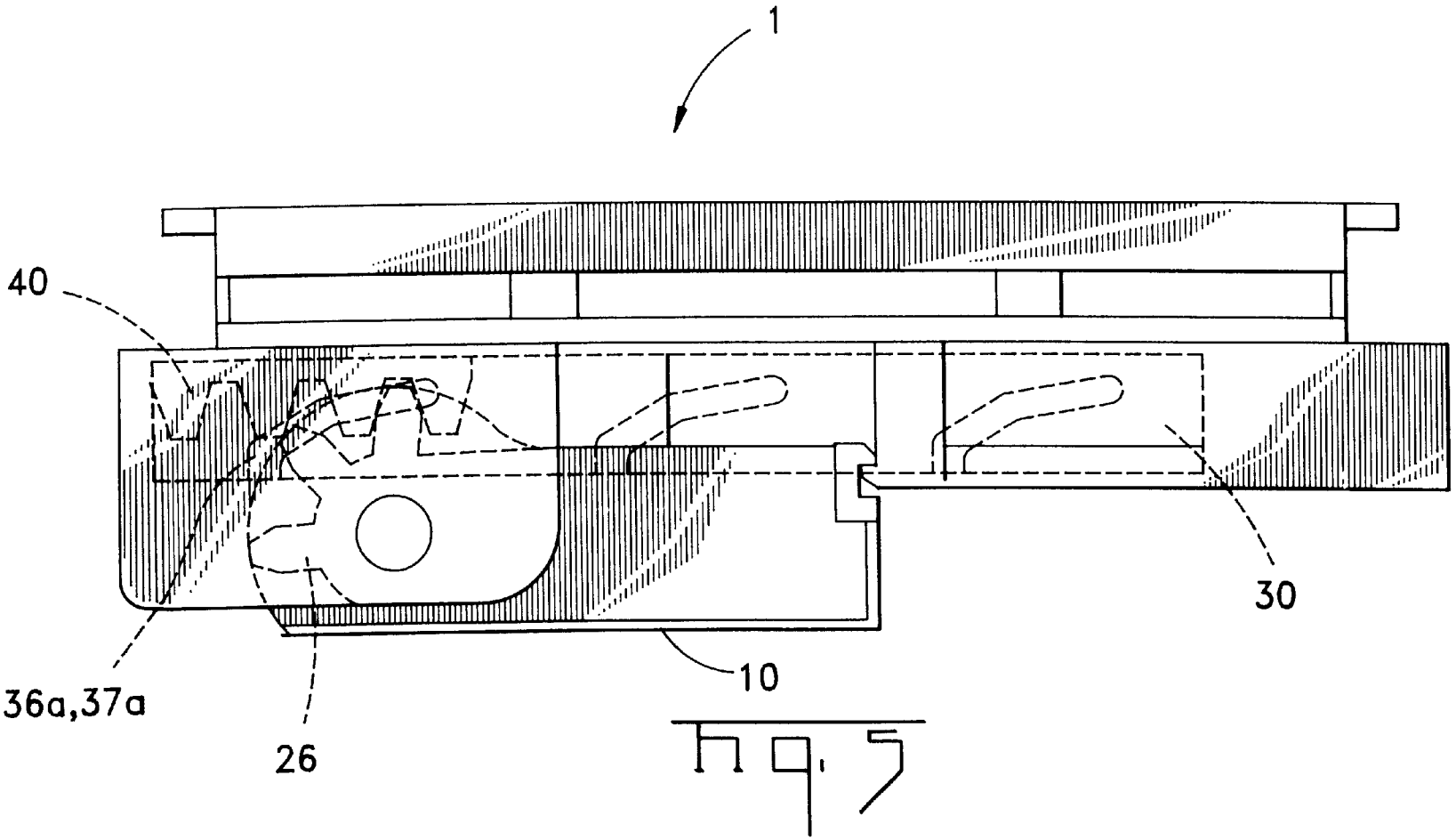
FIG. 5 is a top plan view of the lever-type connector shown in FIG. 1, showing the lever pivoted to the final position.

FIG. 5 is a plan view of the connector 1 showing the lever 10 in the final pivoting position with the plug housings 70 and 72 being omitted. As can be seen from FIG. 5, since the racks 40 overlap with the cam grooves 36*a* and 37*a*, there is no need to increase the size of the connector 1 in the direction of length in order to form the racks 40. Furthermore, it will be seen that even if the gaps between the respective cam grooves 36*a* through 36*c* or 37*a* through 37*c* are narrow, sufficiently long racks can be formed so that the racks can contribute to a lowering of the required mating force. In the embodiment of FIGS. 1–5, the positions of the racks 40 overlap with the cam grooves 36*a* and 37*a*; however, it would also be possible to alter these positions, and to construct the connector 1 so that the racks 40 overlap with the cam grooves 36*b* and 37*b* or cam grooves 36*c* and 37*c*. The engagement position can be freely designed in accordance with the intended application and place of use of the connector 1. Furthermore, if necessary, the racks 40 can be formed so that the racks straddle two cam grooves on each side, e. g., 36*a*, 37*a* and 36*b*, 37*b*. The important point here is that the attachment positions of the racks are unrestricted, and can be set as desired.

Figure 6:
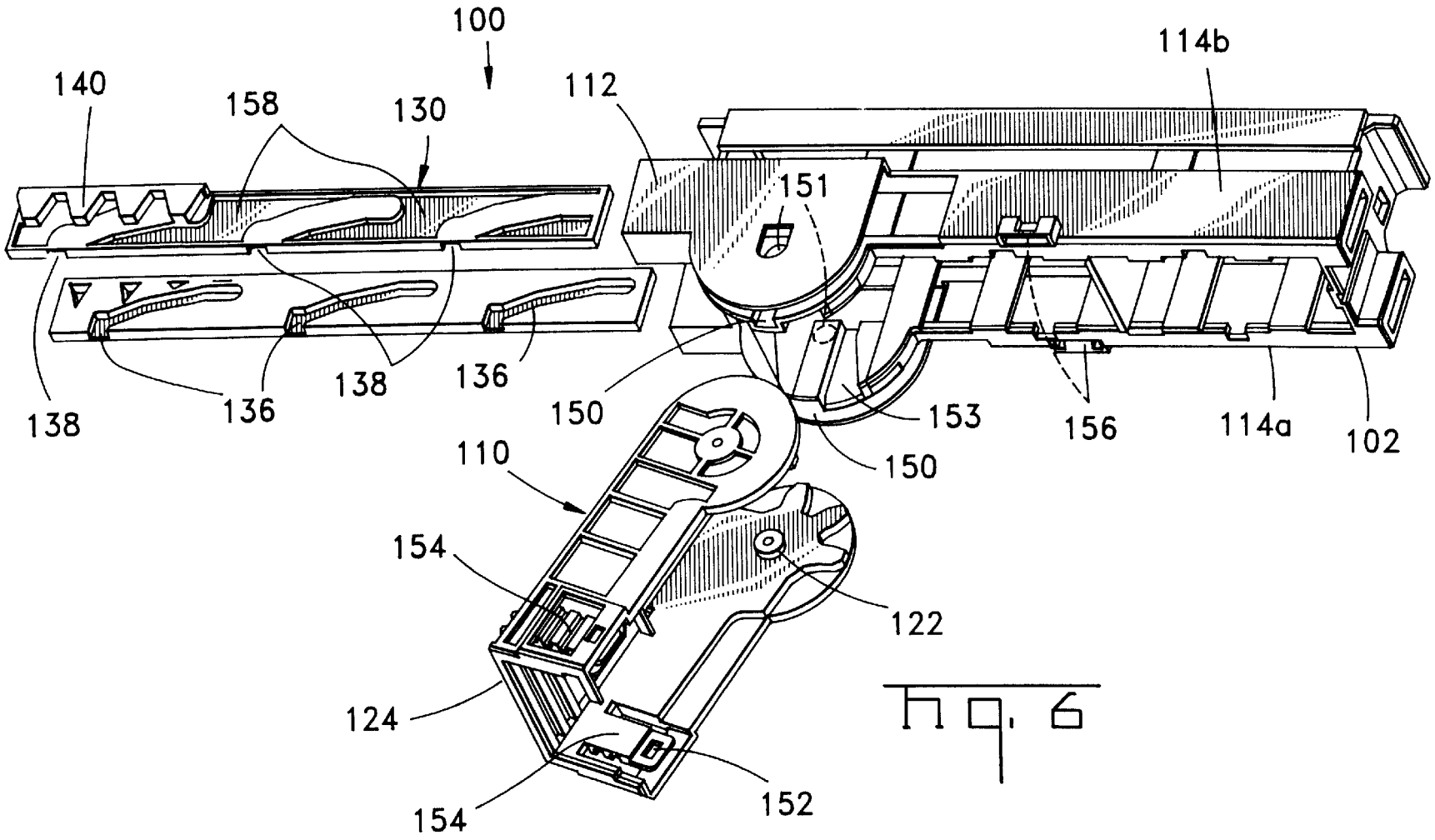
FIG. 6 is an exploded perspective view similar to FIG. 1, showing an alternative embodiment of the lever-type connector of the present invention.
Figure 7:
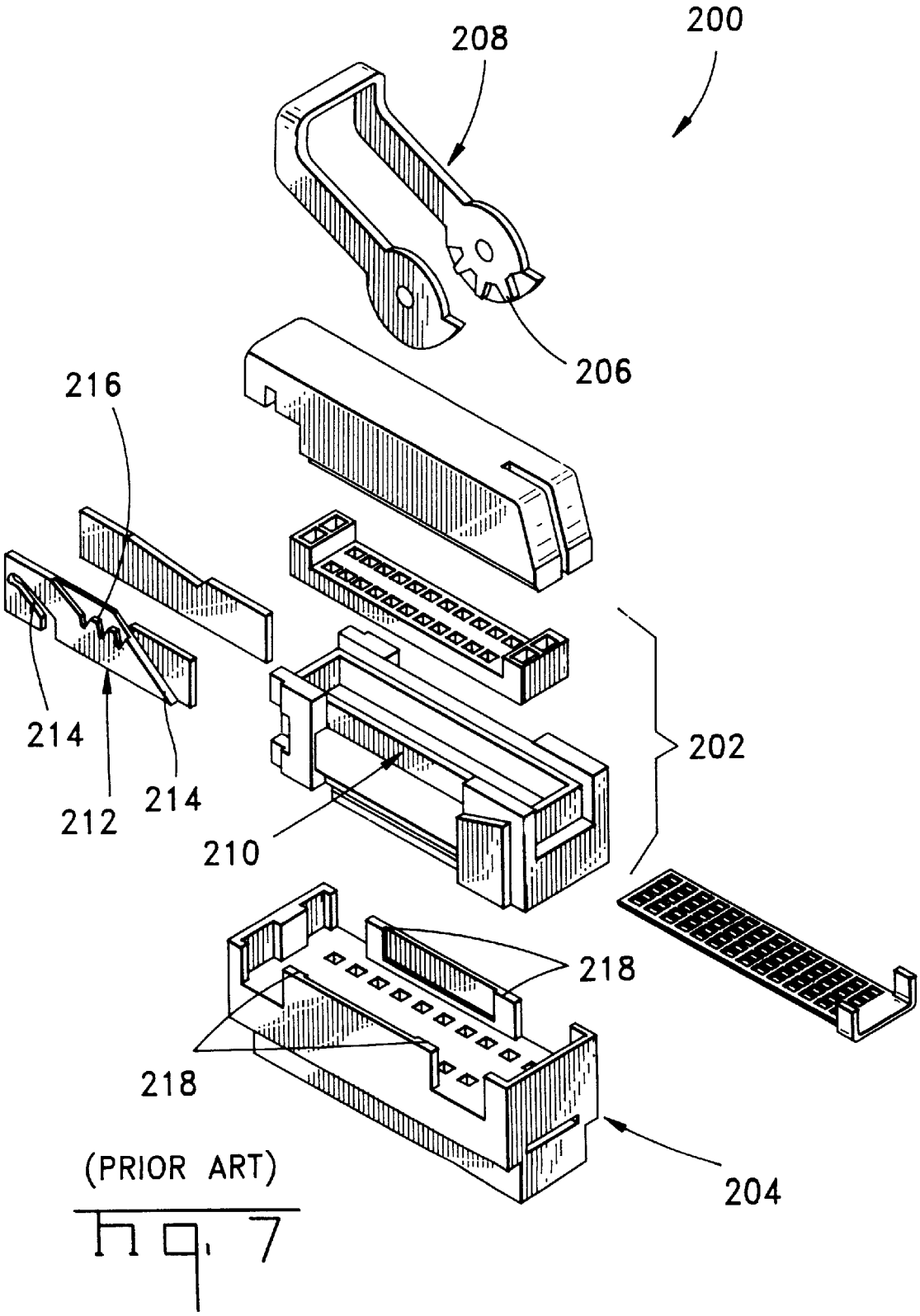
(PRIOR ART) Fig. 7
FIG. 7 is an exploded perspective view of a conventional lever-type connector.

Next, FIG. 6 shows a connector 100 constituting another embodiment of the present invention. Connector 100 has guides 150 which insure smooth insertion of the lever 110 into the lever-mounting sections 112 of the cap housing 102. These guides 150 extend in a direction perpendicular to the direction of length of the connector 100, and have circular recesses 151 on their inside surfaces, which engage with projections 122 on the lever 110. In FIG. 6, guides 153 guide the bosses 76 during the insertion of the plug housing 72.

The operating part 124 of the lever 100 has flexible latching members 154 which have apertures 152 formed in their outer ends. When the lever 110 is completely pivoted, the apertures 152 engage with latching projections 156 formed on the side walls 114*a*, 114*b* of the cap housing 102, so that the lever is latchably fastened in place. In cases where it is desired to release this engagement and remove the plug housings, the engagement can be released by clamping the latching members 154 with the fingers, and pulling the lever 110 up.

The slides 130 are basically the same as those in the previous embodiment; however, in order to reduce the amount of material required, the slides are made thinner by means of cut-out areas 158. The shapes of the racks 140 and cam grooves 136 and 138 are basically the same as in the previous embodiment.

Preferred embodiments of the present invention have been described above in detail; however, it goes without saying that various other modifications and alterations are possible. For example, the racks and cam grooves formed in the slides could be formed in an opposite arrangement from that shown in the embodiments; i. e., the racks could be formed on the inside surfaces of the slides, and the cam grooves formed in the outside surfaces.

In the lever-type connector of the present invention, cam grooves and racks which engage with gears are formed on the opposite sides of the slides from each other. Accordingly, the following merits are obtained:

Specifically, a sufficiently low-mating force can be obtained without increasing the size of the connector. Since the positions of the racks can be freely designed, the degree of freedom in the design of the connector is increased. The size and inclination of the cam grooves can be designed without being restricted by the racks; accordingly, conspicuous merits such as a desired low-mating force, etc., can be obtained using a simple construction.

We claim:

1. A lever-type connector comprising a housing having guide grooves; slides slidably mounted in the guide grooves; each of the slides having a rack and cam grooves, with the rack and cam grooves of each of the slides being disposed on opposite sides thereof, at least one of the cam grooves being disposed in a back to back relationship with the rack; and a lever pivotally mounted on the housing and having gears engagable with the rack of each of the slides to slide the slides along the guide grooves when the lever is operated.

2. A lever-type connector as claimed in claim 1, wherein the housing has a mounting section to which said lever is pivotally mounted.

3. A lever-type connector as claimed in claim 2, wherein the mounting section has holes in which pivot projections on the lever are disposed.

4. A lever-type connector as claimed in claim 3, wherein the mounting section includes guides for guiding the pivot projections to said holes.

5. A lever-type connector as claimed in claim 1, wherein said housing and said lever have latching members for latchably maintaining said lever in an operated position.

* * * * *